US007721757B2

(12) United States Patent
Ginies et al.

(10) Patent No.: US 7,721,757 B2
(45) Date of Patent: May 25, 2010

(54) DISCHARGE CHECK VALVE ASSEMBLY FOR USE WITH HERMETIC SCROLL COMPRESSOR

(75) Inventors: Pierre Ginies, Sathonay Village (FR); Pierre Soulas, Bron (FR); Holger Nicolaisen, Nordborg (DK)

(73) Assignee: Danfoss Maneurop S.A., Trevoux (FR)

( * ) Notice: Subject to any disclaimer, the term of this patent is extended or adjusted under 35 U.S.C. 154(b) by 1159 days.

(21) Appl. No.: 11/109,377

(22) Filed: Apr. 19, 2005

(65) Prior Publication Data

US 2005/0238518 A1 Oct. 27, 2005

Related U.S. Application Data

(60) Provisional application No. 60/565,463, filed on Apr. 26, 2004.

(51) Int. Cl.
*F16K 25/00* (2006.01)
*F04C 18/00* (2006.01)

(52) U.S. Cl. ..... 137/542; 417/902; 137/454.4

(58) Field of Classification Search ..... 417/902; 418/55.1; 137/511, 512.1, 516.15, 454.2, 137/454.4, 540, 542

See application file for complete search history.

(56) References Cited

U.S. PATENT DOCUMENTS 2,771,091 A * 11/1956 Baker et al. ..... 137/542
3,209,777 A * 10/1965 Salisbury ..... 137/315.33
5,141,420 A 8/1992 Nambiar
5,794,657 A * 8/1998 Oberg ..... 137/543.19
6,171,084 B1 1/2001 Wallis et al.
6,428,292 B1 * 8/2002 Wallis et al. ..... 418/55.1
6,582,211 B2 6/2003 Wallis et al.
6,709,247 B1 * 3/2004 Clendenin et al. ..... 418/55.1

FOREIGN PATENT DOCUMENTS

JP 10089277 4/1998

* cited by examiner

*Primary Examiner*—Devon C Kramer
*Assistant Examiner*—Patrick Hamo
(74) *Attorney, Agent, or Firm*—McCormick, Paulding & Huber LLP

(57) ABSTRACT

A discharge check valve assembly for use with a hermetic scroll compressor having a compressor shell is provided. The discharge check valve assembly includes a valve housing and a valve seat located within the valve housing. The valve housing is configured to mount the discharge check valve assembly to the compressor shell. The discharge check valve assembly also includes a discharge fitting and a valve subassembly. The discharge fitting is configured to mount to the compressor shell and configured to connect to a connecting tube in fluid communication with a high-pressure system. The valve subassembly has a valve member movable between an open position and a closed position. Additionally, the valve subassembly is configured to be inserted through the discharge fitting into the valve housing.

14 Claims, 8 Drawing Sheets

DISCHARGE CHECK VALVE ASSEMBLY FOR USE WITH HERMETIC SCROLL COMPRESSOR

CROSS REFERENCE TO RELATED APPLICATIONS

This application is entitled to the benefit of and incorporates by reference essential subject matter disclosed in Provisional Patent Application Ser. No. 60/565,463 filed on Apr. 26, 2004.

FIELD OF THE INVENTION

The invention relates to a discharge check valve assembly for use with a hermetic scroll compressor.

BACKGROUND OF THE INVENTION

Scroll compressor machines, which have two intermeshed involutes or scrolls, provide an efficient way to compress fluids, including gases or mixtures thereof. In operation, one of the scrolls is fixed and the other, an orbiting scroll, is driven by a motor so that it orbits in relation to the fixed scroll. Fluid enters the compressor shell through a low-pressure fluid inlet port and exits through a high-pressure discharge port. The low pressure fluid enters the outer pockets defined by the intermeshed scrolls and is moved toward the center of the intermeshed scrolls or spirals, thereby decreasing in volume and increasing in pressure. The compressed fluid is exhausted through the high-pressure discharge port to the refrigeration or cooling system.

Discharge check valves may be installed in the high-pressure discharge port of the compressor shell to prevent the return of high-pressure refrigerant fluid that may cause reverse movement of the orbiting scroll upon shut down of the compressor.

U.S. Pat. No. 5,141,420 and U.S. Pat. No. 6,171,084 both disclose disc type check valves in the discharge port area of a scroll type hermetic compressor. These valves contain a plurality of components, such as a valve housing, a valve seat element, a valve stop, and a valve disc, each of which must be precisely machined to ensure free movement of the valve disc. Typically, these disc type check valves include an unbiased, planar valve disc.

Such disc type discharge valves are mounted prior to, or in connection with, the welding or permanent attachment of a discharge fitting to the compressor shell. The discharge fitting allows the attachment of suitable conduits to the compressor shell from the rest of the refrigeration system. With these known discharge check valves, once the discharge fitting is attached to the compressor shell, the discharge check valves cannot then be added. Moreover, once these known discharge check valves are assembled to the compressor shell, they cannot be removed without also detaching the discharge fitting from the compressor shell.

Further, these disk type valves are not completely tight, due to insufficient closure force on the unbiased valve element and manufacturing tolerances for the valve element and the valve seat. Even if reverse rotation of the compressor can be avoided when the compressor stops, a certain amount of refrigerant will leak back from the high-pressure side of the refrigeration system into the compressor shell.

In multi-compressor systems, this leads to preservation of high pressure in the discharge compartment inside the hermetic shell of the compressor, when the compressor stops.

Due to this elevated pressure, restarting the compressor requires a higher than normal starting torque.

SUMMARY OF THE INVENTION

It is an object of the invention to provide a leak tight discharge check valve assembly for a hermetic scroll compressor, which is easy and inexpensive to manufacture and to install.

It is a further object of the invention to provide a discharge check valve assembly having a discharge valve subassembly which may be introduced through the discharge fitting after attachment of the discharge fitting to the compressor.

It is another object of the invention to provide a discharge check valve assembly having a discharge valve subassembly which may be removed from the compressor without requiring removal of the permanently attached discharge fitting.

It is even another object of the invention to provide a hermetic scroll compressor with a pressure equalization element for reducing pressure in the high-pressure compartment when the compressor is not operating.

In a first embodiment, a discharge check valve assembly for use with a hermetic scroll compressor having a compressor shell is provided. The discharge check valve assembly includes a valve housing and a valve seat located within the valve housing. The valve housing is configured to mount the discharge check valve assembly to the compressor shell. The discharge check valve assembly also includes a discharge fitting and a valve subassembly. The discharge fitting is configured to mount to the compressor shell and configured to connect to a connecting tube in fluid communication with a high-pressure system. The valve subassembly has a valve member movable between an open position and a closed position. Additionally, the valve subassembly is configured to be inserted through the discharge fitting into the valve housing.

In one aspect, the valve subassembly further includes a valve body defining a bore, a valve member defining a guiding portion slidably receivable in the bore to allow guided movement of the valve member, and a biasing element positioned between the valve member and the valve body for urging the valve member towards the closed position.

In other aspects, the discharge fitting may be integral with the valve housing, or the discharge fitting may be configured to mount to the compressor shell via the valve housing.

In another aspect, the valve housing may be configured such that when the valve housing is mounted to the compressor shell, the valve housing is located substantially outside the compressor shell. Further, the valve subassembly may be configured such that when the valve housing is mounted to the compressor shell, the valve subassembly is located substantially outside the compressor shell.

Alternatively, the valve housing may be configured such that when the valve housing is mounted to the compressor shell, the valve housing is located at least partially inside the compressor shell, and further, the valve subassembly may be configured such that when the valve housing is mounted to the compressor shell, the valve subassembly is located at least partially inside the compressor shell.

The valve body may be attached to the valve housing by one of a brazing method, a welding method, a press-fit method, an adhesive method, or other suitable connecting methods, including the use of mechanical fasteners.

In another aspect, the valve subassembly can be removably inserted through said discharge fitting into the valve housing.

In a further aspect, the valve subassembly also includes a sealing member coupled to the valve member and interposed between the valve member and the valve seat so that, when the valve member is in the closed position, the sealing member is compressed between the valve member and the valve seat.

In an even further aspect, the guiding portion of the valve member extends through the bore of the valve body and a retaining element is coupled to the guiding portion of the valve member to prevent the guiding portion from sliding out of the bore.

In another embodiment, a hermetic scroll compressor may include the inventive discharge valve assembly.

In even another embodiment, a hermetic scroll compressor includes a compressor shell, a compression stage, a delivery valve arrangement, an orifice, a discharge fitting, and pressure equalization means, e.g. at least one pressure equalizing passage. The compressor shell defines an interior volume divided into a low-pressure fluid compartment and a high-pressure fluid compartment. The compression stage has a fixed spiral element and a movable spiral element, the fixed spiral element having an outlet. The delivery valve arrangement is in fluid communication with the outlet of the fixed spiral element. The orifice is formed in the compressor shell to exhaust high-pressure fluid from the compressor. The discharge fitting is affixed over the orifice and configured to provide fluid communication between the high-pressure fluid compartment and a connecting tube in fluid communication with a high-pressure system. The pressure-equalization passage is configured to provide fluid communication between the high-pressure fluid compartment and the low-pressure fluid compartment, wherein the pressure equalization passage is configured to equalize pressures in the high-pressure and low-pressure fluid compartments when the compressor stops.

The hermetic scroll compressor further includes a discharge check valve assembly and a valve subassembly. The discharge valve assembly has a valve housing and a valve seat located within the valve housing, with the valve housing being mounted within the orifice formed in the compressor shell. The valve subassembly includes a valve member movable between an open position and a closed position. Moreover, the valve subassembly is configured to be inserted through the discharge fitting into the valve housing.

The pressure equalization passage may include a lateral passage arranged on the circumferential surface of the fixed spiral element.

In another aspect, the fixed spiral element may include an end plate and an outlet opening extending therethrough, and the pressure equalization passage may be in fluid communication with the outlet opening.

Further, the delivery valve arrangement may include a valve plate coupled to the fixed spiral element, and the pressure equalization passage may extend through the valve plate.

In one aspect, the pressure equalization passage includes a throughbore extending through the end plate of the fixed spiral element. A capillary sleeve may extend at least partway through the throughbore. Furthermore, the capillary sleeve may project above an upper surface of the end plate.

In another aspect, the end plate of the fixed spiral element may include a protrusion on an upper surface and the pressure equalization passage may extend therethrough.

These and other objects, features and advantages of the present invention will become apparent in light of the drawings and detailed description of various embodiments provided below.

DETAILED DESCRIPTION OF THE PREFERRED EMBODIMENTS

Figure 1:
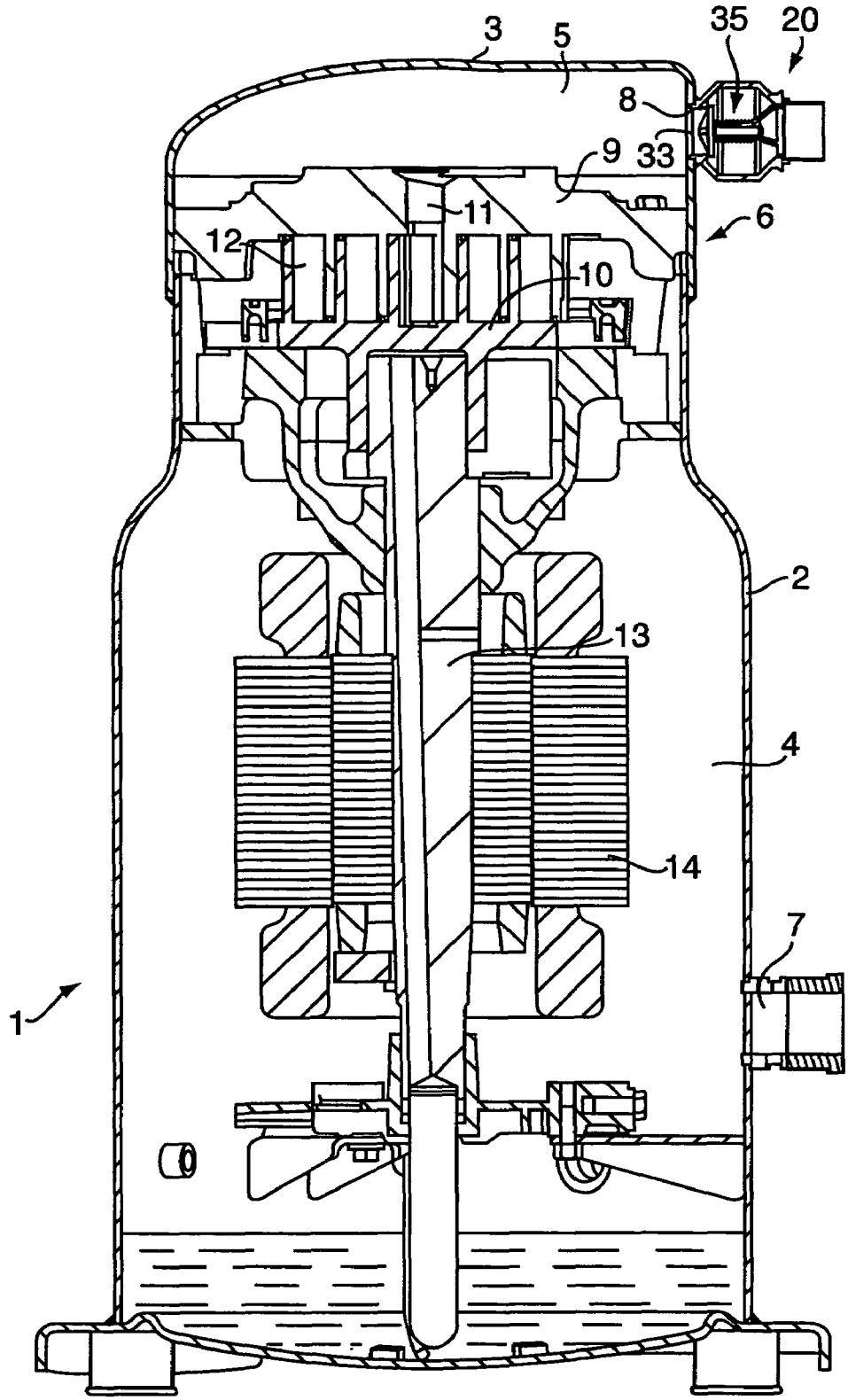
FIG. 1 shows a longitudinal cross sectional view of a hermetic scroll compressor with an inventive discharge check valve assembly.

FIG. 1 shows a hermetic scroll compressor 1 including an enclosure or shell 2, an upper part of which is formed by a cap 3. The volume inside the enclosure 2 is separated into two compartments, a low-pressure fluid-inlet compartment 4, and a high-pressure compartment 5 for outlet of compressed fluid. These two compartments, 4 and 5, are separated by a fluid compression stage 6. Fluid is admitted into the low-pressure compartment via an inlet orifice 7 and compressed fluid is discharged from the high-pressure compartment 5 via an orifice 8 in cap 3. A discharge check valve assembly 20 is arranged in orifice 8.

The compression stage 6 includes a fixed spiral element 9 and a movable spiral element 10, these two spiral elements having interpenetrating parts and defining compression pockets 12. A shaft 13 drives the movable spiral element 10 in an orbital movement. Movement of shaft 13 is provided by a motor 14. During the orbital movement of the spiral element 10, the compression pockets 12 define a volume that gradually decreases from the outside, where the fluid is admitted into the low-pressure compartment, towards the inside, the compressed fluids exiting at the centre of the compression stage 6 to the high-pressure compartment 5 through a central outlet opening 11 in the fixed scroll element 9.

The discharge check valve assembly 20 prevents return flow of fluid from the high pressure side of a refrigeration system into the high-pressure compartment 5 and into the compression pockets 12. High pressure in compartment 5 could cause detrimental reverse rotation of the movable scroll element 10 when the compressor stops.

Figure 2:
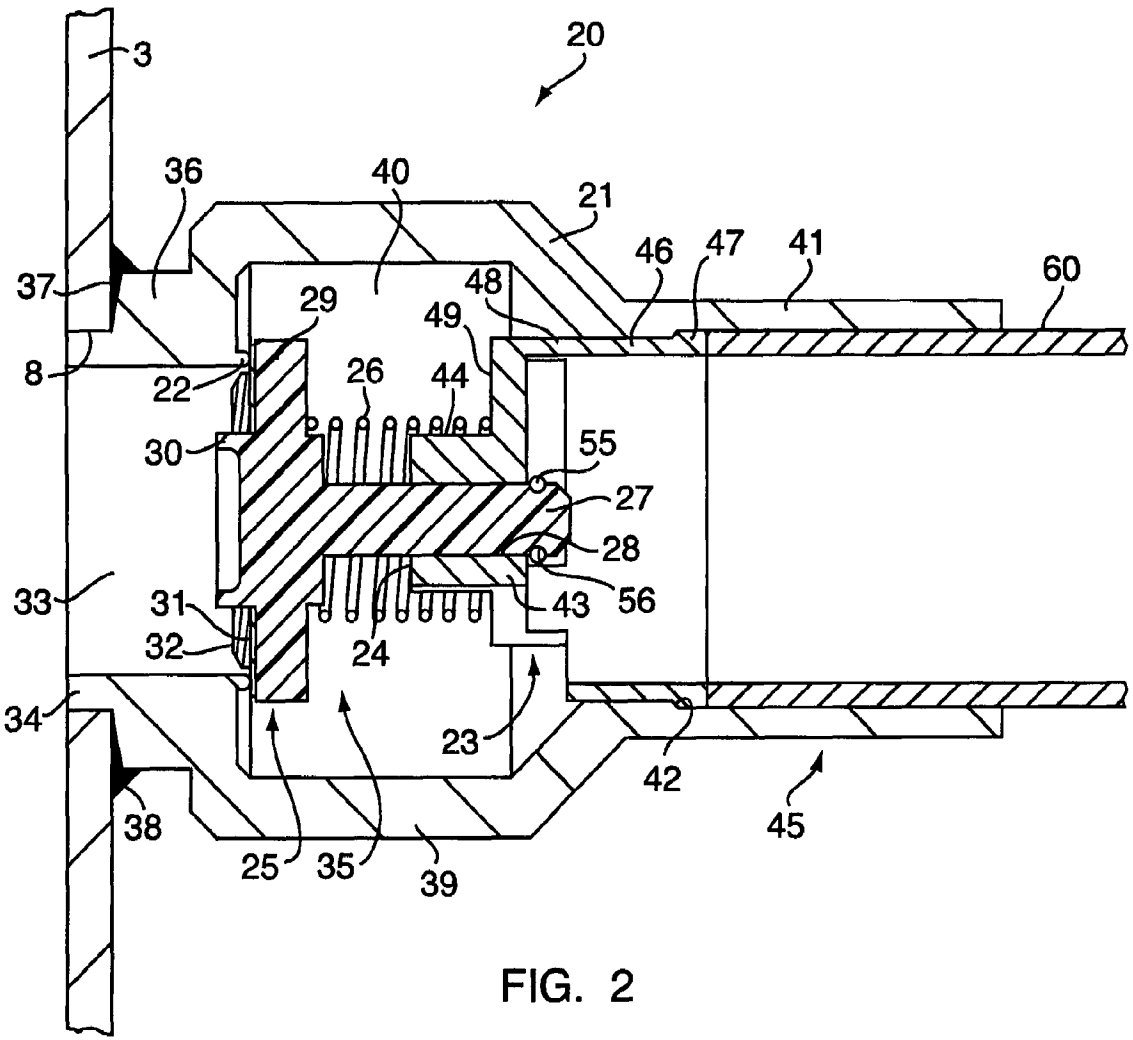
FIG. 2 shows a cross sectional view of a first embodiment of the discharge check valve assembly according to the invention.

In one embodiment shown in FIG. 2, the discharge check valve assembly 20 includes a valve housing 21 having a through passage. Valve housing 21 is externally attached to the upper cap 3 of the compressor shell 2. In this embodiment, the tubular end portion 41 of the substantially tubular valve housing 21 opposite the end attached to cap 3 also serves as a discharge fitting 45, i.e. a fitting for connecting the compressor 1 to the refrigeration or cooling system.

The valve assembly 20 includes an annular valve seat 22, a valve body 23 having a stop surface 24, a valve member 25 biased towards the valve seat 22 by a biasing element or resilient valve spring 26 arranged between the valve member 25 and the valve body 23. The valve member 25 has an elongated guiding portion 27 slidingly movable within a central bore 28 of the valve body 23.

In FIG. 2 the valve assembly 20 is shown with the valve member 25 in a closed position. The valve member 25 includes a plate shaped base part 29. A central boss 30 projects from the base part in a direction towards the valve seat 22. An annular sealing member 31 is arranged on the base part 29 and surrounds the central boss 30. The sealing member is held on the base part 29 by use of a back-up ring 32. The back-up ring presses the sealing member towards the base part and may be secured by a deformation or flanging of the boss 30. In the closed position of the check valve the sealing member 31 abuts the valve seat 22 which projects from the valve housing 21 and surrounds a discharge opening 33.

The valve housing 21 includes a first connecting portion 34, which is inserted in the orifice 8 formed in the upper cap 3 of the compressor shell 2. A welding portion 36 comprises a contact surface 37 abutting the outer surface of the upper cap 3. The valve housing 21 is fixed to the cap 3 by welding seam 38. A portion 39 of the housing 21 of increased diameter surrounds the valve member 25, the valve body 23 and the resilient spring 26, and delimits a valve chamber 40. A tubular end portion 41 of valve housing 21 includes on its inner surface a stop flange 42 for the valve body 23. The tubular end portion 41, acting as a discharge fitting 45, further accommodates a connecting tube 60 to provide fluid communication to the refrigeration system (not shown).

The valve body 23 includes a guiding portion 43 defining a central bore 28 and having a radial outer surface 44. The surface of the bore 28 serves as a sliding bearing for the guiding portion 27 of the valve member. The radial outer surface 44 is adapted to the inner diameter of spring 26. An axial end face 24 of the guiding portion serves as a stop surface for the base part 29 and limits the opening movement of the valve member 25. An annular fixation portion 46 having a flange 47 projecting in a radially outward direction and abutting stop flange 42 of the valve housing 21 determines the position of the valve body within housing 21. A plurality of leg members 48 connect the guiding portion 43 and the fixation portion 46 of the valve body, without overly disturbing the flow path of the discharge fluid.

The valve spring 26 is arranged between a surface 49 of the valve body 23 and the base part 29 of the valve member 25. In one aspect of the invention, the spring constant of the valve spring 26 is relatively weak, as the spring essentially only has to compensate for friction losses in the valve body to ensure that the check valve closes when the compressor is not operating. Spring 26 need not be limited to a spiral wound compression spring, as shown in FIG. 2, but may be any elastically deformable element having a suitable spring constant.

Figure 3:
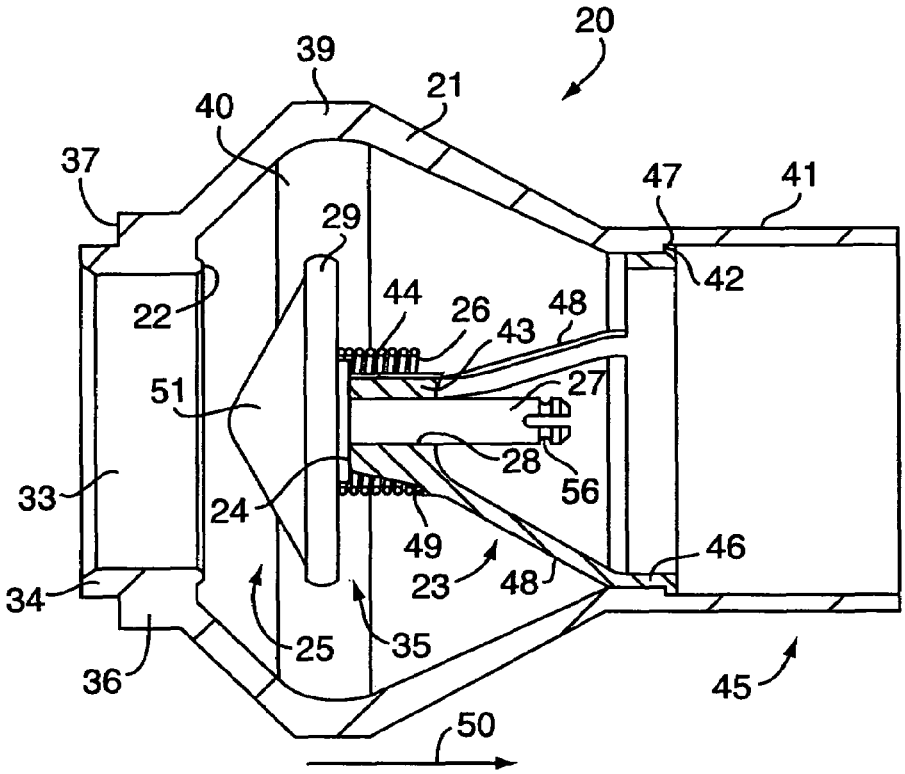
FIG. 3 shows a second embodiment of a discharge check valve assembly according to the invention.

FIG. 3 shows another embodiment of the discharge check valve assembly 20. In this embodiment, a valve position is illustrated, where the compressor is in operation, thus delivering compressed fluid from the discharge opening 33 towards the downstream components of the refrigeration system. The direction of fluid flow is illustrated by the arrow 50. The valve member 25 abuts the stop surface 24 of the valve body, and the resilient spring 26 is almost completely compressed. In distinction to FIG. 2, the valve member 25 in this embodiment is a unitary part, preferably made of a material exhibiting sufficient sealing characteristics in connection with the metal valve seat 22. A suitable material for the valve member may be Teflon (PTFE), which also has excellent lubrication behavior in connection with the valve body. However, the present invention is not limited in this regard and other appropriate materials known to those skilled in the pertinent art to which the present invention pertains may be substituted without departing from the broader aspect of the invention. With this design, the manufacturing costs may be further decreased.

To minimize pressure losses in the discharge flow, the valve member 25 has in its central portion a conically shaped boss 51. Further, the interior shape of the valve housing 21 is adapted to the conical boss 51 to realize an undisturbed flow path for the discharge fluid within the valve chamber 40 with substantially constant flow cross section through the entire valve assembly.

Figure 4:
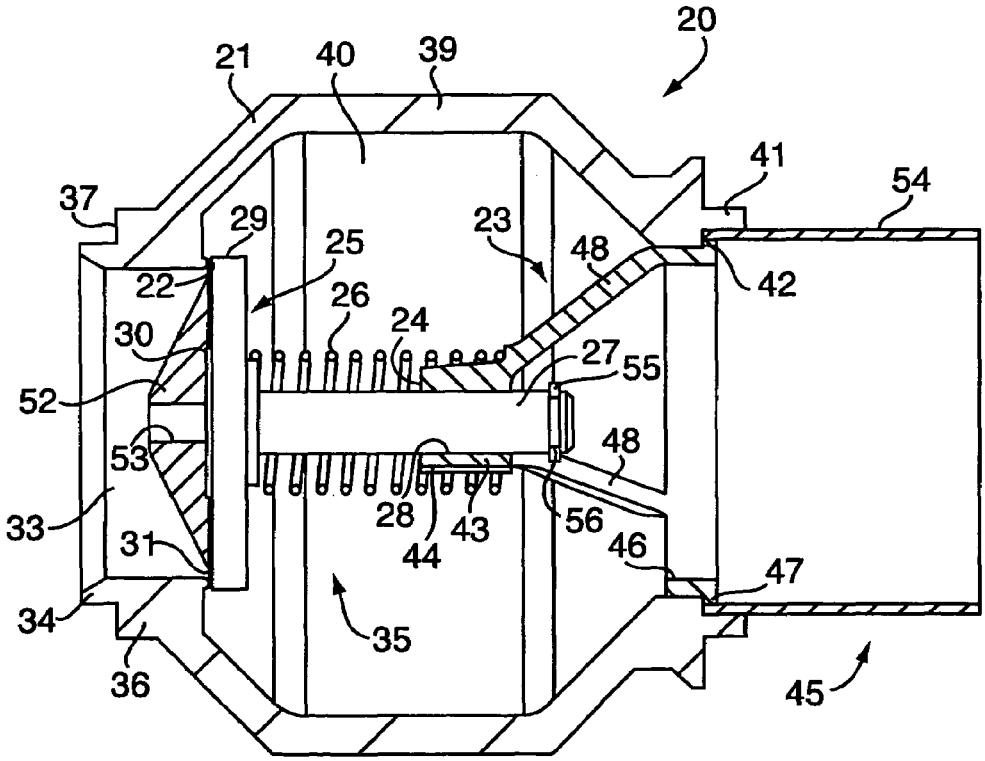
FIG. 4 shows a third embodiment of a discharge check valve assembly according to the invention.

FIG. 4 shows a third embodiment of the valve assembly 20, where the valve member 25 includes a planar base part 29 with a boss 30, an annular sealing member 31 and a retaining element 52. The retaining element has a conical shape for minimization of flow resistance and covers both boss 30 and the sealing member, except for the area of the sealing member abutting the valve seat 22. Retaining element 52 may be fixed to the base part 29 by means of a threaded bolt or a rivet (not shown) arranged in a central bore 53.

Where the valve housing 21/discharge fittings 45 in FIGS. 2 and 3 have been represented as a unitary member, the housing 21 of FIG. 4 is now attached to a separate tubular end portion 54 acting as discharge fitting 45. Tubular end portion 54 may be attached to the housing in the area of stop flange 42 by any suitable fixation means, e.g. by welding or brazing. In one aspect, end portion 54 is a simple tubular part having reduced wall thickness compared to the housing. This feature simplifies the attachment of connecting tubes to the refrigeration system, which typically is done by the manufacturer of the refrigeration system. The relatively thin wall allows fast heating of the end portion 54 to the required brazing temperature. The reduced heat input leads to less heating of other components of the valve assembly and minimizes the risk of thermal damage to these parts. Preferably, the end portion 54 is made of a bi-metal-material, e.g. a stainless steel tube pre-plated on its inner surface. This further facilitates the brazing operation for the connecting tube.

Figure 5:
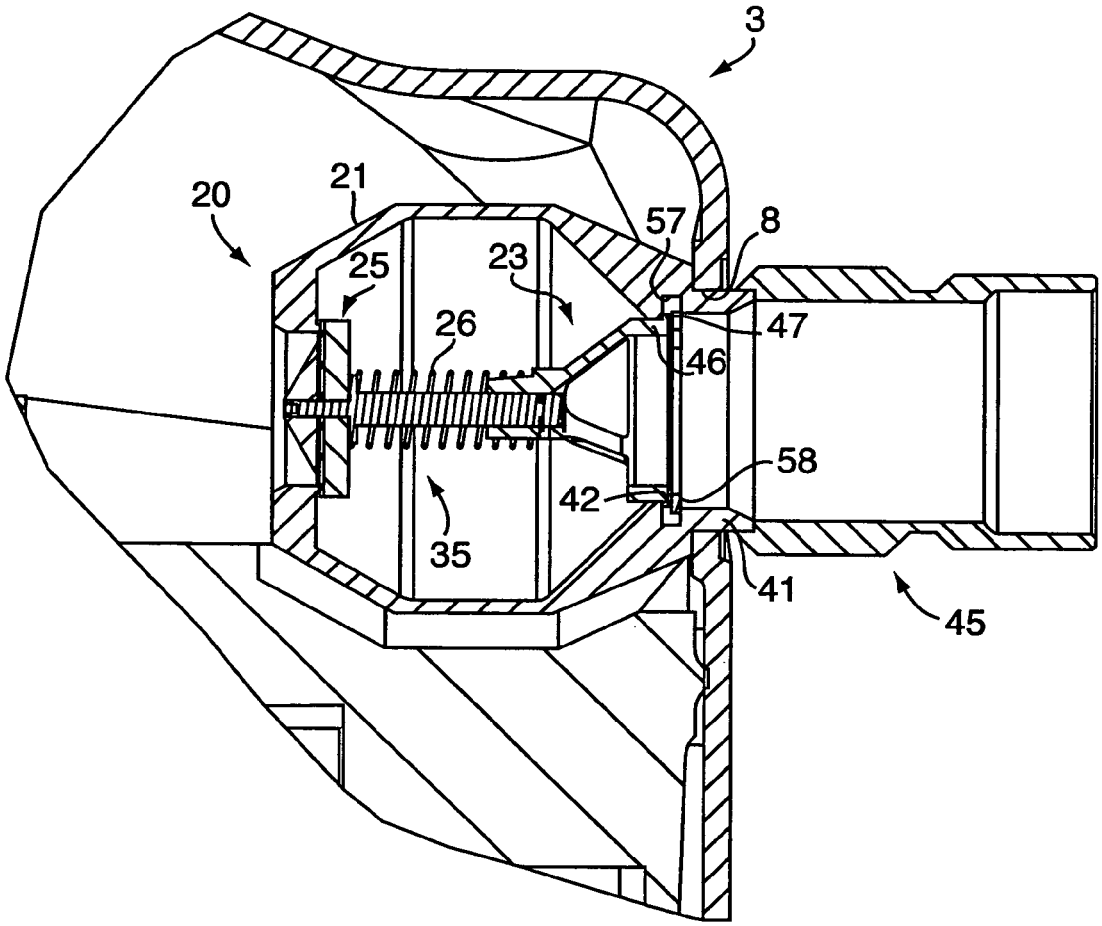
FIG. 5 shows a fourth embodiment of a discharge check valve assembly according to the invention.

In FIGS. 1-4, the discharge valve assembly 20 is configured to be mounted completely on the exterior of the compressor shell 2, and the valve subassembly 35 is located outside the compressor. In such embodiments, no additional space inside the compressor shell is required when the discharge check valve assembly is integrated into the discharge fitting. FIG. 5 shows another embodiment, wherein the discharge valve assembly 20 and the valve subassembly 35 are at least partially located inside cap 3 of the compressor shell 2. Tubular end portion 41 of discharge valve assembly 20 is positioned within and extends through orifice 8. Circumferential notch 57 is formed in the interior surface of tubular end portion 41 and incorporates stop flange 42. Valve body 23 of valve subassembly 35 includes annular fixation portion 46 having a radial projecting flange 47. When valve subassembly 35 is inserted within valve housing 21, flange 47 abuts stop flange 42 of housing 20. Retaining element 58, e.g. a snap ring or spring clip, snaps into notch 57 and retains valve subassembly 35 with housing 20. Other suitable retaining elements as known to person of ordinary skill in the art may be used to hold valve subassembly against stop flange 42. Discharge fitting 45 is shown affixed to the portion of tubular end portion 41 extending from orifice 8. Alternatively, discharge fitting could be affixed to shell 2 or to both tubular end portion 41 and shell 2.

In all of the previously disclosed embodiments, the valve subassembly 35 including the valve member 25, the valve body 23 and the spring 26 is pre-assembled prior to mounting into the valve housing 21. For that purpose, a retaining element 55 (see FIGS. 2 and 4), e.g. a spring clip, is arranged in a radial groove 56 near the axial end of the elongated guiding portion 27 of the valve member 25. FIG. 3 shows radial groove 56 without retaining element 55 for clarity. Element 55 prevents the valve body and the valve member from becoming separated during the mounting operation.

As the outer diameter of the valve member 25 and of the entire valve subassembly 35 is less than the inner diameter of the discharge fitting 45 and the inner diameter of the tubular end portion 41 of the housing, the valve subassembly 35 can be inserted into the housing from the side remote to the compressor shell 2 after the discharge fitting 45 has been affixed to the valve housing 21 or to the compressor shell 2. Thus, the valve subassembly 35 can be inserted through the discharge fitting 45 and into the valve housing 21 after finalized, on-site mounting of the compressor. This allows greater flexibility in ordering and installing compressors, in that identical compressors may be operated with or without the discharge check valve subassembly 35 or, alternatively, a compressor originally configured for operation with a discharge check valve assembly may be simply and easily reconfigured for use without a discharge check valve assembly, or vice versa.

In addition, in those embodiments wherein the valve subassembly 35 is not permanently affixed to the valve housing 21, the valve subassembly 35 may be removed from valve housing 21 through the discharge fitting 45 without requiring removal of the permanently attached discharge fitting. This is particularly useful in case of valve failure.

The insertion depth of the valve subassembly 35 is limited by the abutment of flange 47 of the valve body 23 on stop flange 42 of the housing. The valve body 23 may be secured to the housing by means of a press fit, adhesive, brazing or welding between valve body and housing, or other suitable connecting methods, including the use of mechanical fasteners.

During operation of the compressor 1, the high pressure of the discharge fluid from the compression stage will be exerted against the valve member 25 and thereby against the force of the valve spring 26. The high pressure causes the valve member to move towards an open position. When fully open, the valve member may abut the valve body stop surface 24.

When the compressor stops, the high pressure in the discharge line of the system will force the valve member to its closed position and prevent any refrigerant fluids from leaking back into the compressor shell. The valve assembly, according to the invention, also reduces the risk of undesirable reverse rotation of the orbiting scroll set 10 by preventing back flow of refrigerant fluid at high pressure into the compression pockets 12, when the compressor stops.

Figure 6:
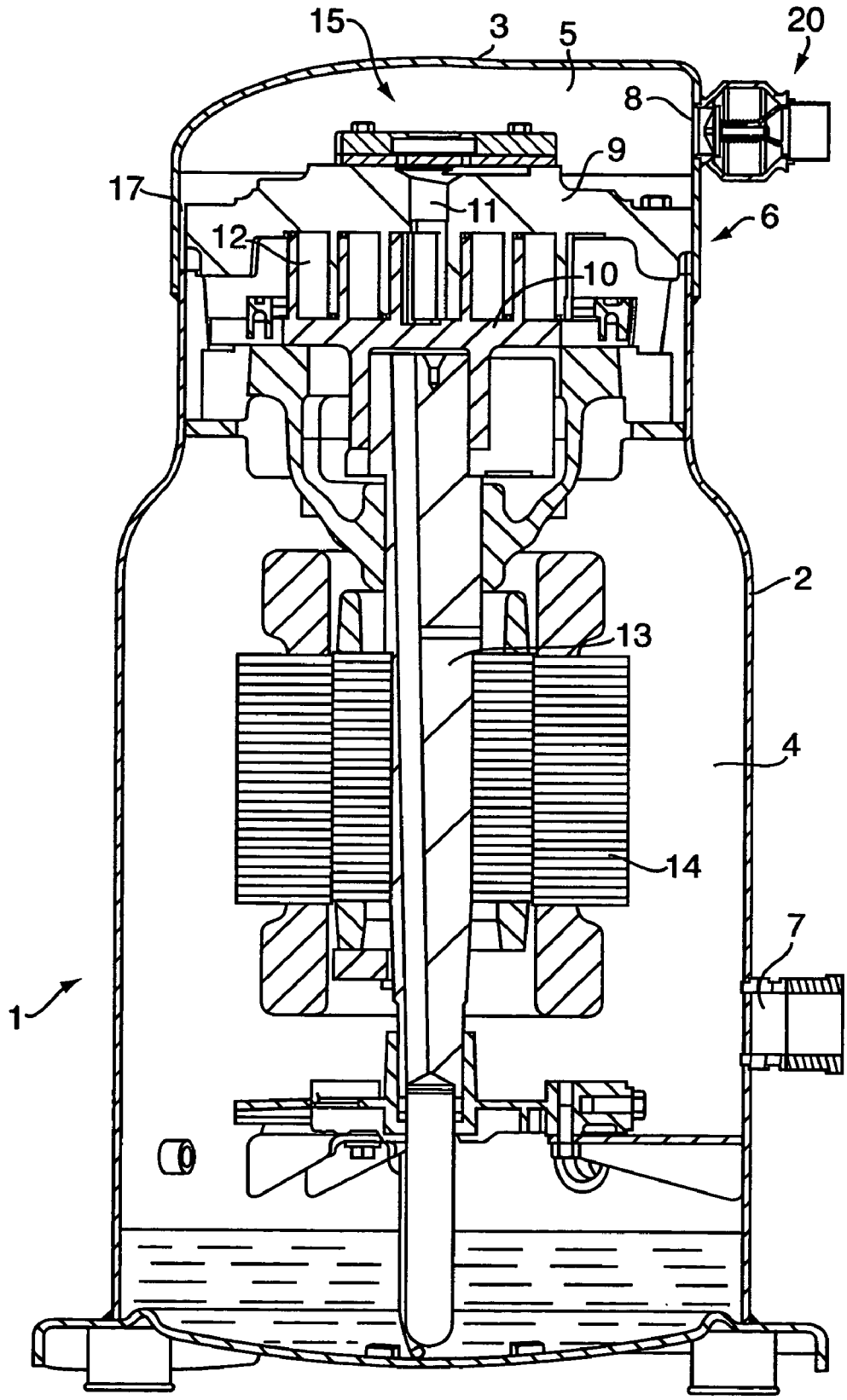
FIG. 6 shows a longitudinal cross sectional view of a hermetic scroll compressor equipped with a delivery valve arrangement and a pressure equalizing passage.

FIG. 6 shows a hermetic scroll compressor which is additionally equipped with a delivery valve arrangement denoted by the general reference number 15. Such valve arrangements, as known in the art prevent return flow of fluid from the high-pressure compartment 5 to the compression pockets 12, when the pressure in the central compression pocket is less than the pressure in the high-pressure compartment.

As shown in FIG. 6, the compressor includes pressure-equalizing means in the form of a lateral passage 17 arranged in a circumferential surface of the fixed spiral element 9. Lateral passage 17 provides fluid communication between the high-pressure compartment 5 and the low pressure compartment 4. If no equalizing means were present in such a compressor, the high-pressure compartment 5 would remain at a high-pressure level when the compressor stops, due to the closing action of both the delivery valve arrangement 15 and the discharge valve assembly 20. The pressure equalizing means serves to decrease the pressure in the compartment 5 towards the pressure level in the low-pressure compartment 4. This in turn reduces the required starting torque for the motor, when the compressor is next operated. Further, the pressure equalizing means allows return of any lubricant separated from the refrigerant fluid flow in the high-pressure compartment 5 towards the oil sump at the bottom of the shell 2, even during operation of the compressor.

Figure 7:
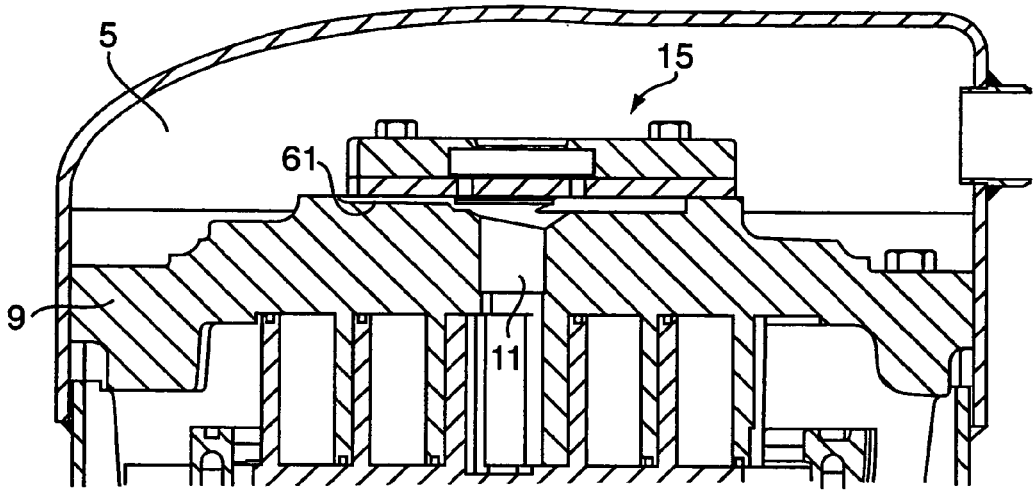
FIGS. 7-11 show other embodiments of pressure equalizing passages.

FIGS. 7 to 11 show other embodiments of pressure equalizing and oil return means for a compressor. In FIG. 7 a passage 61 is arranged in the end plate of the fixed spiral member 9. Passage 61 provides fluid communication between high-pressure compartment 5 with the outlet opening 11 of the spiral member 9. Pressure equalization between high-pressure compartment 5 and low-pressure compartment 4 occurs in this case by leakage through compression pockets 12. However, in this case, oil return will only occur during a stop period of the compressor.

Figure 8:
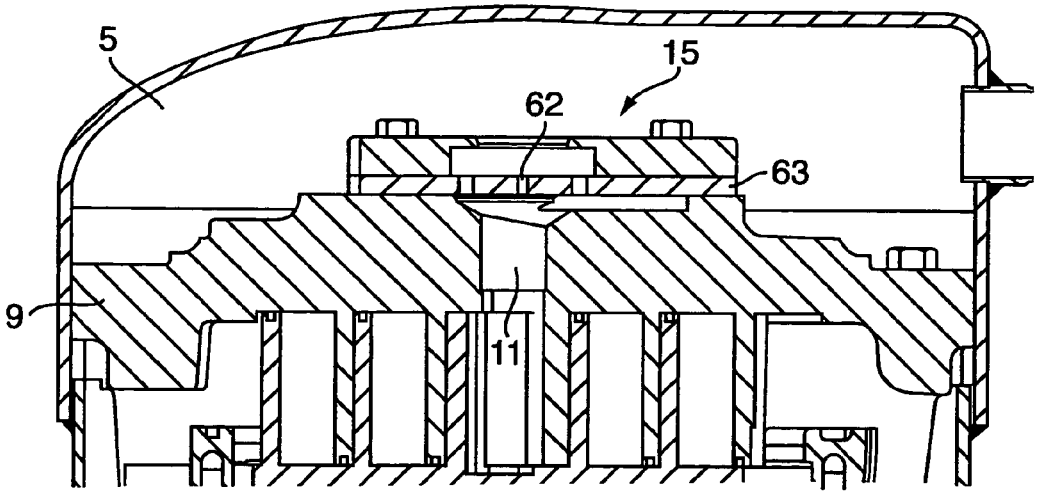

In FIG. 8 pressure equalization and oil return occurs in a similar manner as disclosed above for FIG. 7. As shown in FIG. 8, a passage 62 is arranged in the valve plate 63 of the delivery valve arrangement 15. Passage 62 places the high-pressure compartment 5 in fluid communication with the outlet opening 11.

Figure 9:
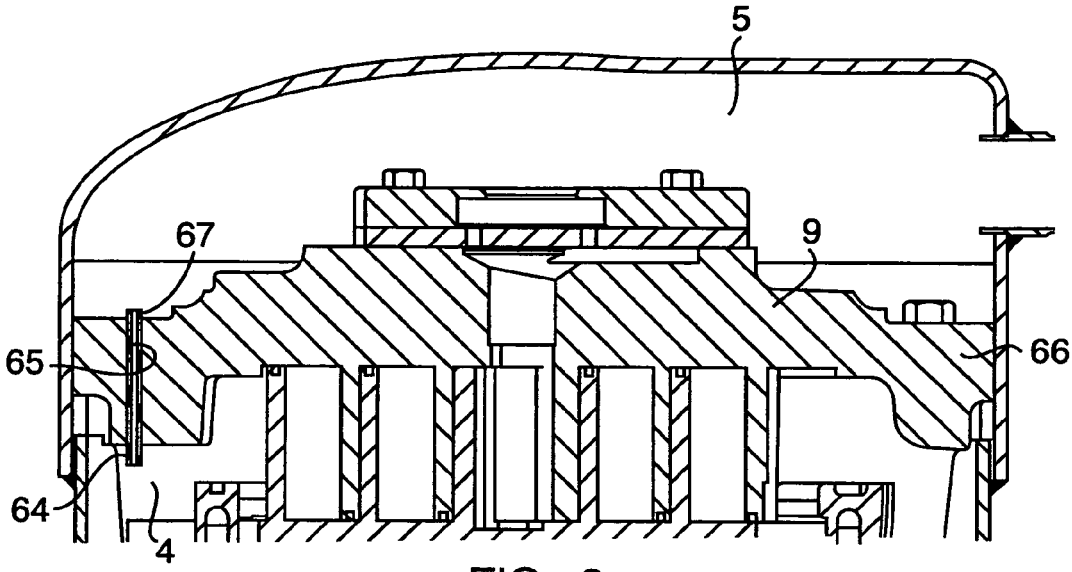

In FIG. 9 a capillary tube 64 is arranged in an axial bore 65 through the radial outer portion 66 of the fixed spiral element 9, which limits the lowest level of the high-pressure compartment 5. The upper end portion 67 of capillary tube 64 may project from the surface of the fixed spiral element 9, as shown in FIG. 9. By extending the capillary tube 64 above the surface, an oil reservoir is established at the radial outer portion 66. This oil reservoir may also catch and retain impurities, e.g. dust or dirt particles, which could block the free passage in capillary tube 64.

Figure 10:
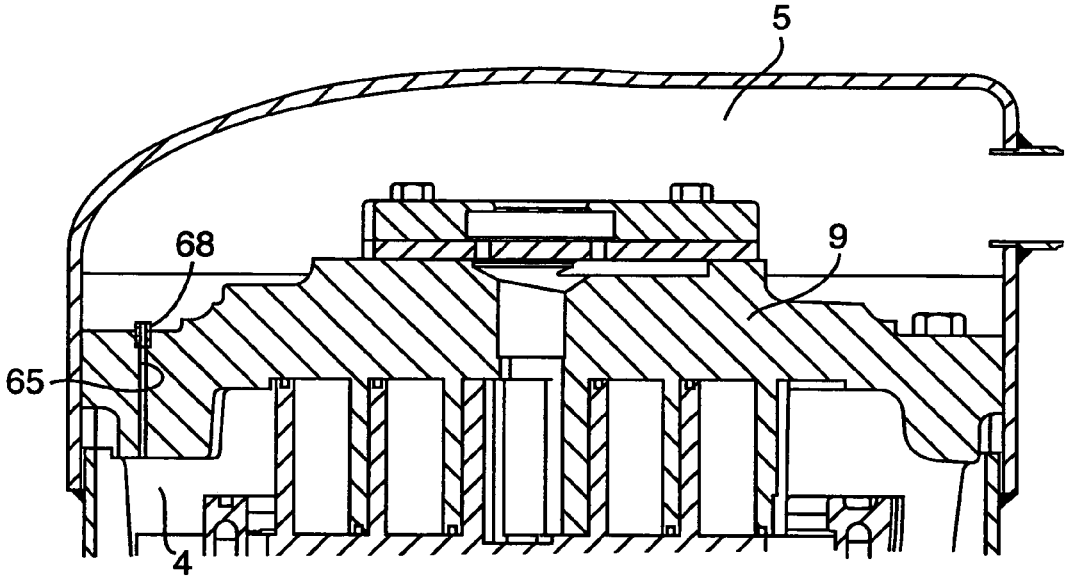
Figure 11:
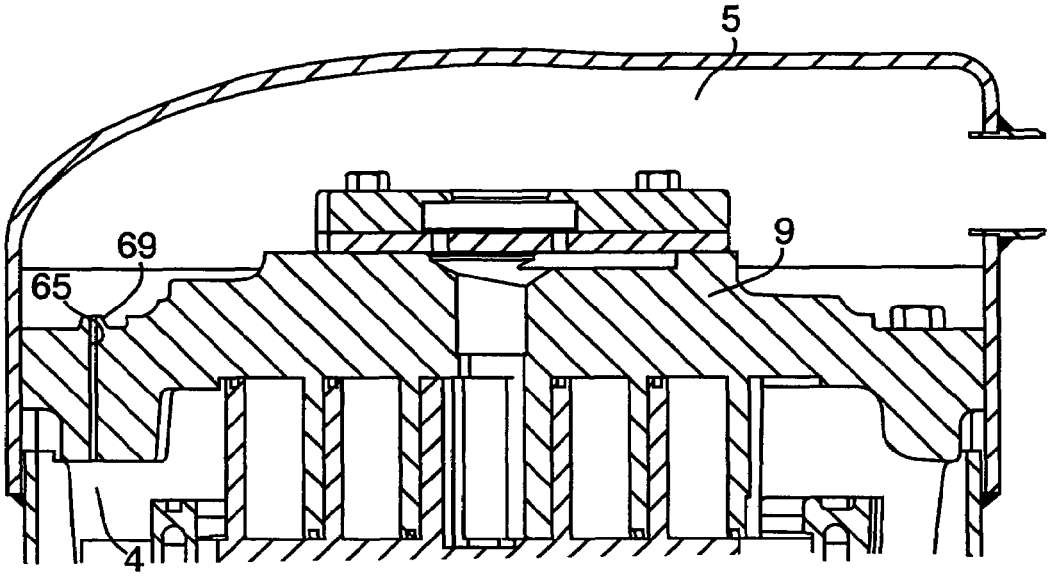

The same effect of preventing blockage of the pressure equalizing and oil return passage is achieved by the embodiments of FIG. 10, where a capillary sleeve 68 is arranged in a bore 65, and of FIG. 11, where a protrusion 69 is formed on the upper surface of fixed spiral element 9, surrounding bore 65.

Although the present invention has been described with respect to discharge check valve assemblies for scroll compressors, the claimed invention may be easily adapted for used with any pressurized vessel. Father, although this invention has been shown and described with respect to the detailed embodiments thereof, it will be understood by those skilled in the art that various changes in form and detail thereof may be made without departing from the spirit and scope of the invention.

What is claimed is:

1. A discharge check valve assembly for use with a hermetic scroll compressor having a compressor shell, the discharge check valve assembly comprising:

a valve housing and a valve seat located within said valve housing, said valve housing having a first portion configured to mount said discharge check valve assembly to the compressor shell;

a discharge fitting disposed on a second portion of the valve housing and configured to connect to a connecting tube in fluid communication with a high-pressure system; and a valve subassembly including a valve body defining a bore and a valve member defining a guiding portion slidably receivable in said bore to allow guided movement of said valve member between an open position and a closed position;

wherein said valve subassembly is configured to be inserted through said discharge fitting and said second portion of the valve housing into said valve housing.

2. The discharge check valve assembly of claim 1, wherein said valve subassembly further includes a biasing element positioned between said valve member and said valve body for urging said valve member towards said closed position.

3. The discharge check valve assembly of claim 1, wherein said discharge fitting is integral with said valve housing.

4. The discharge check valve assembly of claim 1, wherein said valve housing is configured such that when said valve housing is mounted to said compressor shell, said valve housing is located substantially outside the compressor shell.

5. The discharge check valve assembly of claim 1, wherein said valve subassembly is configured such that when said valve housing is mounted to said compressor shell, said valve subassembly is located substantially outside the compressor shell.

6. The discharge check valve assembly of claim 1, wherein said valve housing is configured such that when said valve housing is mounted to said compressor shell, said valve housing is located at least partially inside the compressor shell.

7. The discharge check valve assembly of claim 1, wherein said valve subassembly is configured such that when said valve housing is mounted to said compressor shell, said valve subassembly is located at least partially inside the compressor shell.

8. The discharge check valve assembly of claim 2, wherein said valve body is attached to said valve housing by one of a brazing method, a welding method, a press-fit method, an adhesive method, and a mechanical fastening method.

9. The discharge check valve assembly of claim 1, wherein said valve subassembly can be removably inserted through said discharge fitting into said valve housing.

10. The discharge check valve assembly of claim 2, wherein said valve subassembly further includes:

a sealing member coupled to said valve member and interposed between said valve member and said valve seat so that, when said valve member is in said closed position, said sealing member is compressed between said valve member and said valve seat.

11. The discharge valve assembly of claim 2, wherein said guiding portion of said valve member extends through said bore of said valve body; and wherein a retaining element is coupled to said guiding portion of said valve member to prevent said guiding portion from sliding out of said bore.

12. A hermetic scroll compressor comprising:

a compressor shell;

a discharge check valve assembly including:

a valve housing and a valve seat located within said valve housing, said valve housing affixed to said compressor shell at a first portion of the valve housing;

a discharge fitting disposed on a second portion of the valve housing and configured to connect to a connecting tube in fluid communication with a high-pressure system; and a valve subassembly including a valve body defining a bore and a valve member defining a guiding portion slidably receivable in said bore to allow guided movement of said valve member between an open position and a closed position;

wherein said valve subassembly is configured to be inserted through said discharge fitting and said second portion of the valve housing into said valve housing.

13. The discharge check valve assembly of claim 1, wherein the valve member includes a conically shaped boss; and wherein an interior shape of the valve housing is adapted to the conically shaped boss forming a substantially constant flow cross section through the entire valve assembly to realize a substantially undisturbed flow path through the valve housing.

14. The discharge check valve assembly of claim 1, wherein the first portion is a first end of the valve housing and the second portion is a second end of the valve housing.

* * * * *